US011181125B2

(12) United States Patent
Chang et al.

(10) Patent No.: US 11,181,125 B2
(45) Date of Patent: Nov. 23, 2021

(54) FAN FRAME BODY WITH DAMPING STRUCTURE AND FAN THEREOF

(71) Applicant: ASIA VITAL COMPONENTS CO., LTD., New Taipei (TW)

(72) Inventors: Bor-Haw Chang, New Taipei (TW); Chung-Shu Wang, New Taipei (TW)

(73) Assignee: ASIA VITAL COMPONENTS CO., LTD., New Taipei (TW)

( * ) Notice: Subject to any disclaimer, the term of this patent is extended or adjusted under 35 U.S.C. 154(b) by 136 days.

(21) Appl. No.: 15/959,299

(22) Filed: Apr. 23, 2018

(65) Prior Publication Data

US 2019/0323523 A1 Oct. 24, 2019

(51) Int. Cl.

| | |
|---|---|
| ***F04D 29/66*** | (2006.01) |
| ***F04D 25/06*** | (2006.01) |
| ***F04D 29/52*** | (2006.01) |
| ***F04D 29/40*** | (2006.01) |

(52) U.S. Cl.

CPC ..... *F04D 29/668* (2013.01); *F04D 25/0646* (2013.01); *F04D 29/403* (2013.01); *F04D 29/526* (2013.01); *F05B 2240/14* (2013.01); *F05B 2240/20* (2013.01); *F05B 2280/401* (2013.01)

(58) Field of Classification Search

None

See application file for complete search history.

(56) References Cited

U.S. PATENT DOCUMENTS

| | | | | |
|---|---|---|---|---|
| 3,947,148 A * | 3/1976 | Holt | F04D 29/664 | 415/119 |
| 4,086,022 A * | 4/1978 | Freeman | F01D 11/08 | 415/119 |
| 4,692,091 A * | 9/1987 | Ritenour | F04D 29/526 | 415/119 |
| 5,215,433 A * | 6/1993 | Weiland | F04D 29/526 | 415/119 |
| 6,164,911 A * | 12/2000 | LeBlanc | F04D 29/4213 | 415/117 |
| 6,394,751 B1 * | 5/2002 | Daudel | F04D 27/0207 | 415/208.3 |
| 6,896,095 B2 * | 5/2005 | Shah | F01P 5/06 | 181/198 |

(Continued)

*Primary Examiner* — Michael Lebentritt
*Assistant Examiner* — Jason G Davis
(74) *Attorney, Agent, or Firm* — Demian K. Jackson; Jackson IPG PLLC

(57) ABSTRACT

A fan frame body with damping structure and a fan thereof. The fan frame body includes a fan frame main body having a first opening, a second opening, a flow way and a base section. The first and second openings are respectively positioned at the upper and lower ends of the fan frame main body. The flow way is disposed between the first and second openings in communication with the first and second openings. The base section is disposed at the second opening. A bearing cup and multiple static blades are perpendicularly disposed on the base section. Two ends of the static blades are respectively connected with the base section and the fan frame main body. Multiple damping structures are annularly disposed on an inner wall of the fan frame main body. The damping structures are raised body structures or recess structures.

18 Claims, 8 Drawing Sheets

(56) References Cited

U.S. PATENT DOCUMENTS

| | | | | |
|---|---|---|---|---|
| 7,080,970 | B2 * | 7/2006 | Horng | F04D 29/526<br>361/695 |
| 2006/0067816 | A1 * | 3/2006 | Chang | F04D 29/542<br>415/191 |
| 2015/0219120 | A1 * | 8/2015 | Chang | F04D 29/668<br>415/119 |
| 2016/0102672 | A1 * | 4/2016 | Liu | F04D 29/058<br>417/423.12 |

* cited by examiner (a)

(b)

(a)

(b)

(a)

(b)

(a)

(b)

(a)

(b)

(a)

(b)

(a)

(b)

(a)

(b)

FAN FRAME BODY WITH DAMPING STRUCTURE AND FAN THEREOF

BACKGROUND OF THE INVENTION

1. Field of the Invention

The present invention relates generally to a fan frame body and a fan thereof, and more particularly to a fan frame body with damping structure and a fan thereof.

2. Description of the Related Art

In the field of heat dissipation, a conventional fan is used to create cooling airflow for forcedly carrying away the heat so as to effectively dissipate the heat. The principle of the creation of cooling airflow of the fan is that the fan blades of the rotor are designed with vane configuration. A motor and a circuit board are used to drive the rotor to rotate by a nominal speed. The vane-shaped fan blades rotate to work and create push force so as to create cooling airflow. When the rotor is rotated, unnecessary fundamental frequency vibration of the fan frame often takes place to make noise. Moreover, when the fan applied to a server or a computer rotates, the fundamental frequency vibration of the fan will affect the hard disk reading efficiency of the server and the computer. In addition, the fundamental frequency vibration of the rotor in rotation will shorten the lifetime of the fan itself and the server and the computer or the like information technology equipment or a communication equipment, a domestic and audio/video equipment or an industrial equipment. Currently, there are several ways to lower the fundamental frequency vibration of the rotor of the fan, including counterbalancing and rectifying the rotor or adding pads or other vibration absorption and sound insulation material to the fan frame to absorb the vibration.

However, in the above manner, additional materials such as the counterweight and vibration absorption pad are applied to the fan so that the cost is increased.

It is therefore tried by the applicant to provide a fan frame body with damping structure and a fan thereof to lower the fundamental frequency vibration of the fan so as to prolong the lifetime of the fan frame, the server and the computer or the like information technology equipment and enhance the hard disk reading efficiency and lower the cost for the damping structure.

SUMMARY OF THE INVENTION

It is therefore a primary object of the present invention to provide a fan frame body with damping structure and a fan thereof to lower the fundamental frequency vibration of the fan frame and lower the cost for the damping structures.

It is a further object of the present invention to provide a fan frame body with damping structure and a fan thereof to prolong the lifetime of the fan frame and the equipment employing the fan such as a server and a computer or the like information technology equipment or a communication equipment, a domestic and audio/video equipment or an industrial equipment and enhance the hard disk reading efficiency thereof.

To achieve the above and other objects, the fan frame body with damping structure includes a fan frame main body having a first opening, a second opening, a flow way and a base section. The first and second openings are respectively positioned at the upper and lower ends of the fan frame main body. The flow way is disposed between the first and second openings in communication with the first and second openings. The base section is disposed at the second opening. A bearing cup and multiple static blades are perpendicularly disposed on the base section. Two ends of the static blades are respectively connected with the base section and the fan frame main body. Multiple damping structures are annularly disposed on an inner wall of the fan frame main body. The damping structures are raised body structures or recess structures.

To achieve the above and other objects, the fan of the fan frame body with damping structure includes: a stator assembly having multiple silicon steel sheets and multiple windings wound around the silicon steel sheets, the stator assembly being fitted around the bearing cup; a rotor assembly having a central shaft, a hub and a permanent magnet, the central shaft being perpendicularly assembled with the hub, multiple fan blades being annularly disposed on outer circumference of the hub, the permanent magnet being disposed on inner circumference of the hub; and a bearing disposed in the bearing cup, the central shaft being rotatably disposed in the bearing.

By means of the design of the present invention, the damping structures can reinforce the structure of the fan frame main body to lower 30~50% of the vibration amplitude of the fundamental frequency vibration. In this case, the equipment employing the fan frame body with damping structure and the fan thereof, (such as a server or a computer) can have better hard disk reading efficiency.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
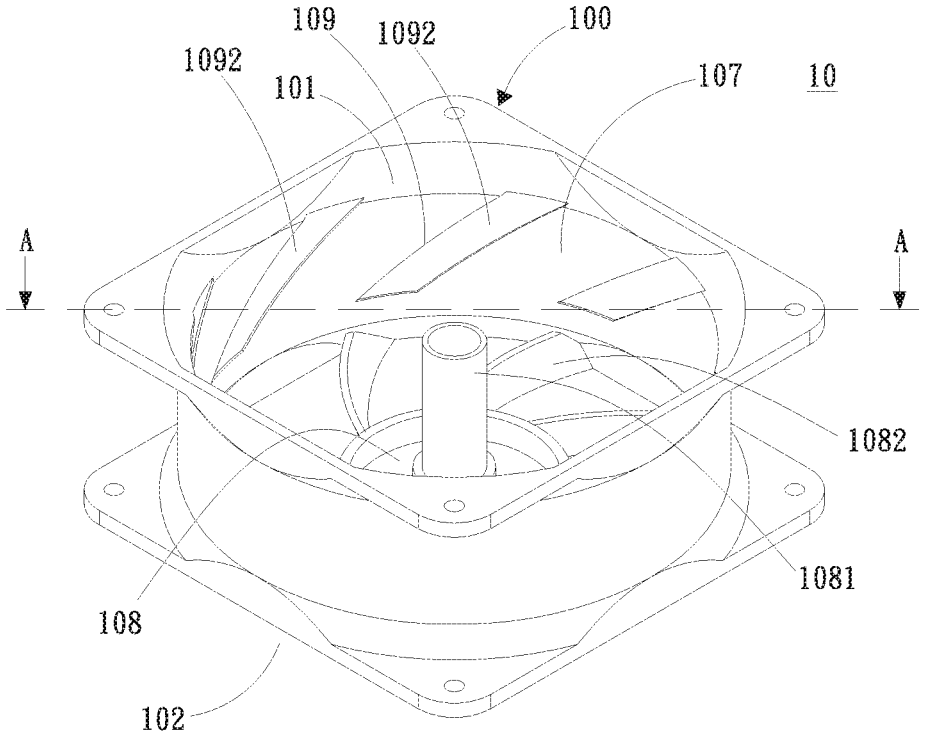
FIG. 1 is a perspective view of a first embodiment of the fan frame body with damping structure of the present invention.
Figure 1:
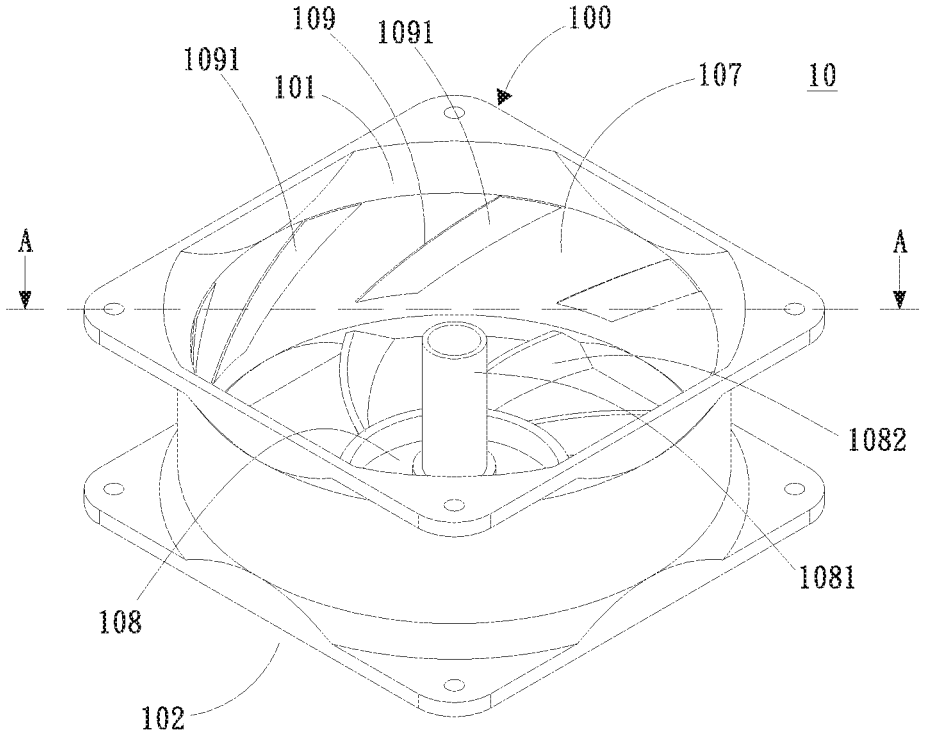
Figure 2:
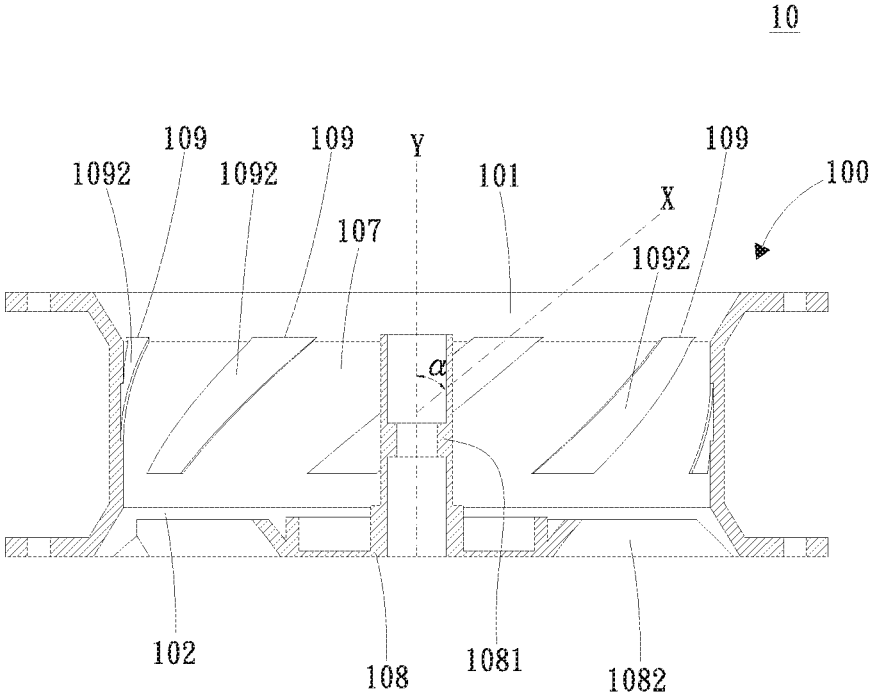
FIG. 2 is a sectional view of the first embodiment of the fan frame body with damping structure of the present invention, taken along line A-A of FIG. 1.
Figure 2:
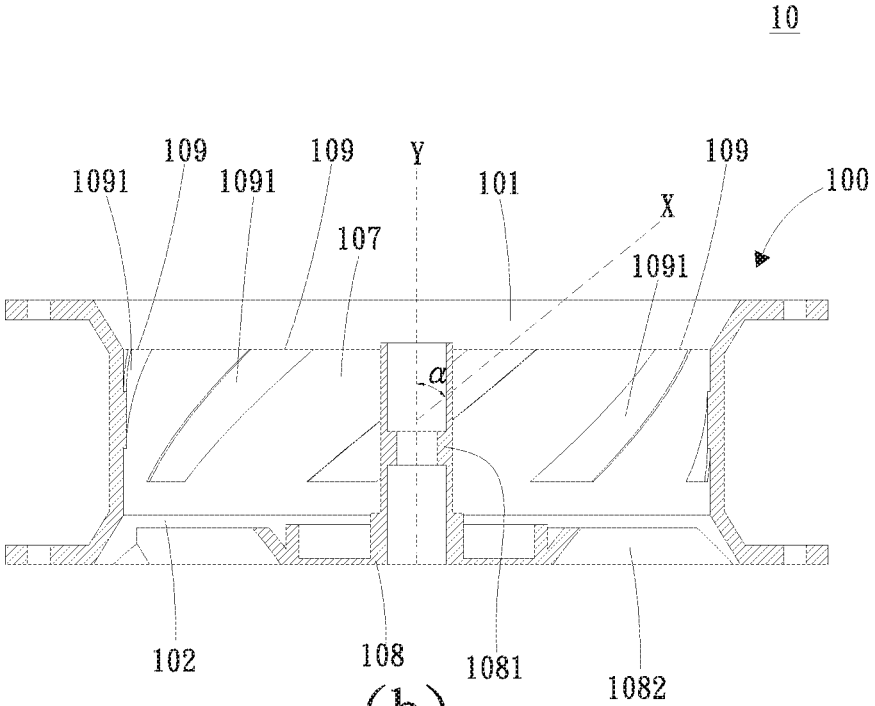
Figure 3:
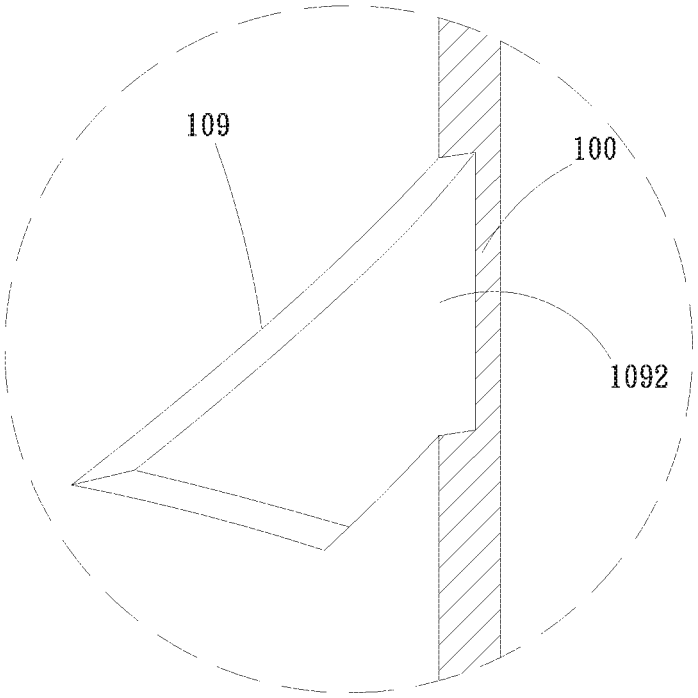
FIG. 3 is an enlarged view of a part of the first embodiment of the fan frame body with damping structure of the present invention.
Figure 3:
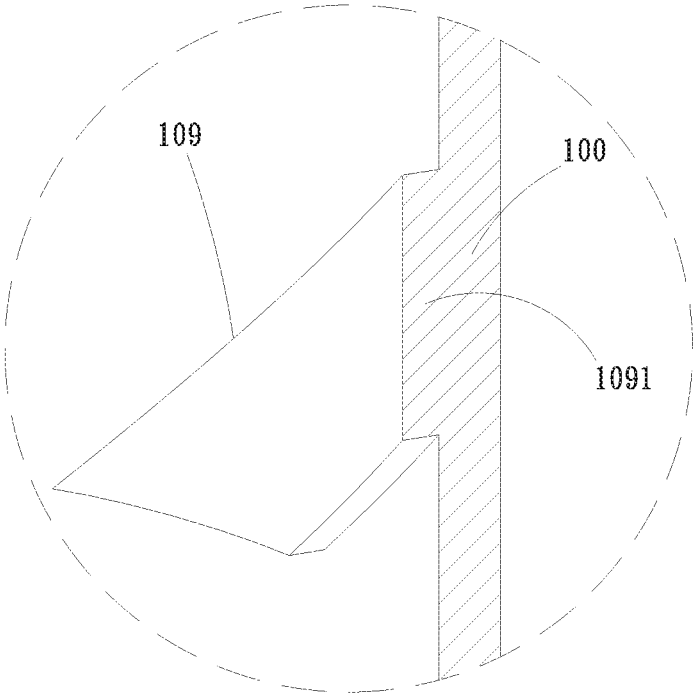

Please refer to FIGS. 1, 2 and 3. FIG. 1 is a perspective view of a first embodiment of the fan frame body with damping structure of the present invention. FIG. 2 is a sectional view of the first embodiment of the fan frame body with damping structure of the present invention, taken along line A-A of FIG. 1. FIG. 3 is an enlarged view of a part of the first embodiment of the fan frame body with damping structure of the present invention. As shown in the drawings, the fan frame body 10 with damping structure of the present invention includes a fan frame main body 100. In this embodiment, the fan frame main body 100 has only one single support frame. However, the number of the support frames is not limited to one. Some modified embodiments will be described hereinafter.

The fan frame main body 100 has a first opening 101, a second opening 102, a flow way 107 and a base section 108. The first and second openings 101, 102 are respectively positioned at the upper and lower ends of the fan frame main body 100. The flow way 107 is disposed between the first and second openings 101, 102 in communication with the first and second openings 101, 102. The base section 108 is disposed at the second opening 102. A bearing cup 1081 and multiple static blades 1082 are perpendicularly disposed on the base section 108. Two ends of the static blades 1082 are respectively connected with the base section 108 and the fan frame main body 100. Multiple damping structures 109 are annularly disposed on an inner wall of the fan frame main body 100. The damping structures 109 are selectively raised body structures 1091 or recess structures 1092.

The damping structures 109 have a geometrical form. In this embodiment, the damping structures 109 are, but not limited to, in the form of a parallelogram. In other embodiments, the damping structures 109 can have another geometrical form, such as rectangular, circular and elliptic configuration. In addition, the damping structures 109 respectively define a damping structure virtual axis X. In this embodiment, the damping structure virtual axes X of every damping structure 109 are parallel to each other. In a modified embodiment, the damping structure virtual axes X of every damping structure 109 can be alternatively unparallel to each other. The fan frame main body 100 defines a fan frame main body virtual axis Y. The fan frame main body virtual axis Y and the damping structure virtual axes X contain an angle $\alpha$ ranging from one degree to 179 degrees or 181 degree to 359 degrees. In this embodiment, the damping structures 109 are uniformly annularly arranged, that is, the damping structures 109 are arranged at equal intervals. In a modified embodiment, the damping structures 109 can be alternatively non-uniformly annularly arranged.

By means of the design of the present invention, the arrangement of the damping structures 109 can reinforce the structure of the fan frame main body 100 to lower 30~50% of the vibration amplitude of the fundamental frequency vibration. In this case, the equipment employing the fan, (such as a server or a computer or the like information technology equipment or a communication equipment, a domestic and audio/video equipment or an industrial equipment) can have better hard disk reading efficiency or lower the vibration of the equipment to enhance the stability.

Figure 4:
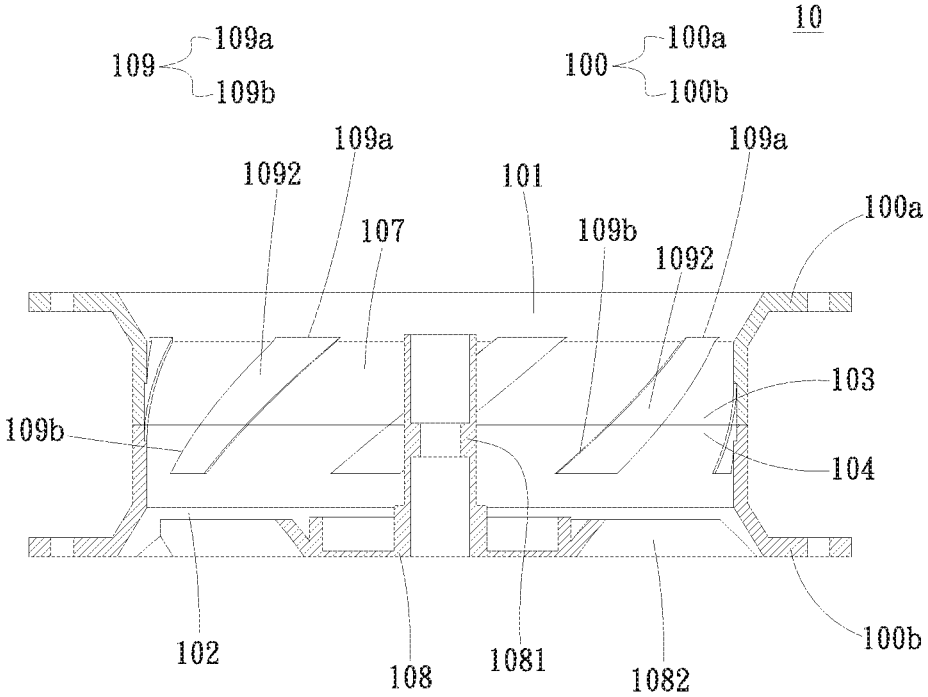
FIG. 4 is a sectional view of a second embodiment of the fan frame body with damping structure of the present invention, taken along line A-A of FIG. 1.
Figure 4:
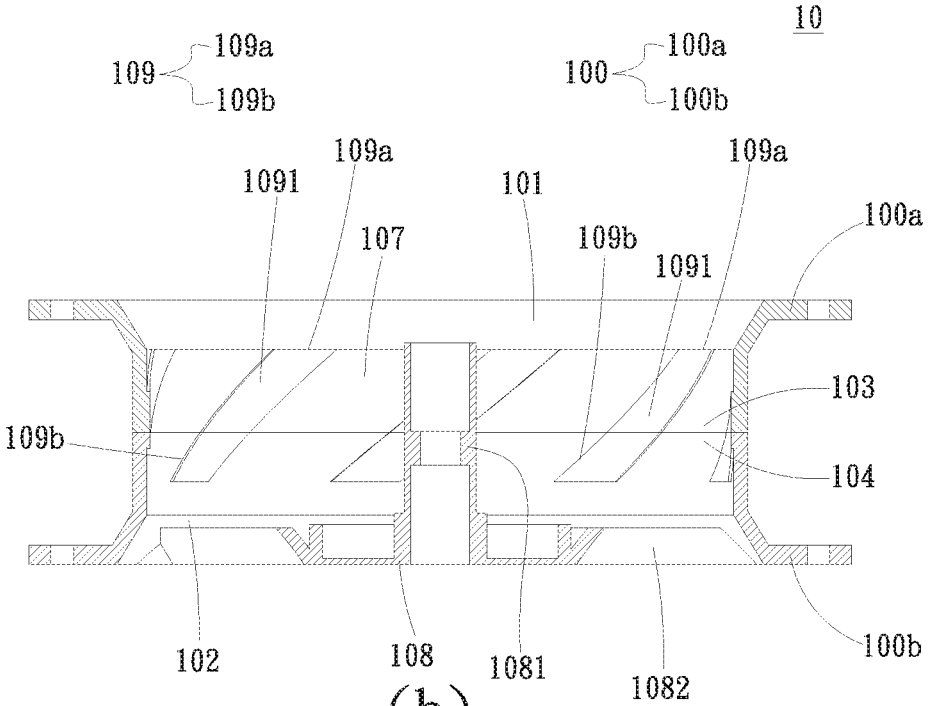

Please now refer to FIG. 4 and supplementally to FIGS. 1,2 and 3. FIG. 4 is a sectional view of a second embodiment of the fan frame body with damping structure of the present invention, taken along line A-A of FIG. 1. The second embodiment is partially identical to the first embodiment in structure and function and thus will not be redundantly described hereinafter. The second embodiment is different from the first embodiment in that the fan frame main body 100 has multiple support frames. The multiple support frames are axially overlapped to form the fan frame main body 100 and the damping structures 109. The axially overlapped support frames can be connected with each other by means of screws, engagement structures or injection molding.

In this embodiment, the support frames of the fan frame main body 100 include a first support frame 100*a* and a second support frame 100*b*. The first opening 101 is formed on an upper side of the first support frame 100*a*. A third opening 103 is formed on a lower side of the first support frame 100*a*. The second opening 102 is formed on a lower side of the second support frame 100*b*. A fourth opening 104 is formed on an upper side of the second support frame 100*b*. The first and second support frames 100*a*, 100*b* are made of different materials.

The damping structure 109 has a first part 109*a* and a second part 109*b*. The first part 109*a* is formed on the first support frame 100*a*. The second part 109*b* is formed on the second support frame 100*b* corresponding to the first part 109*a*. The first and second support frames 100*a*, 100*b* are axially overlapped to form the fan frame main body 100. The third opening 103 of the first support frame 100*a* corresponds to the fourth opening 104 of the second support frame 100*b*. The first and second parts 109*a*, 109*b* correspondingly form the damping structure 109. The materials of the first support frame 100*a* and the second support frame 100*b* are different from each other. For example, the first support frame 100*a* is made of PBT material, while the second support frame 100*b* is made of PA66 material. The vibration frequencies of the different materials are different from each other so that the co-vibration of the first and second support frames 100*a*, 100*b* can be further reduced to lower the noise.

Figure 5:
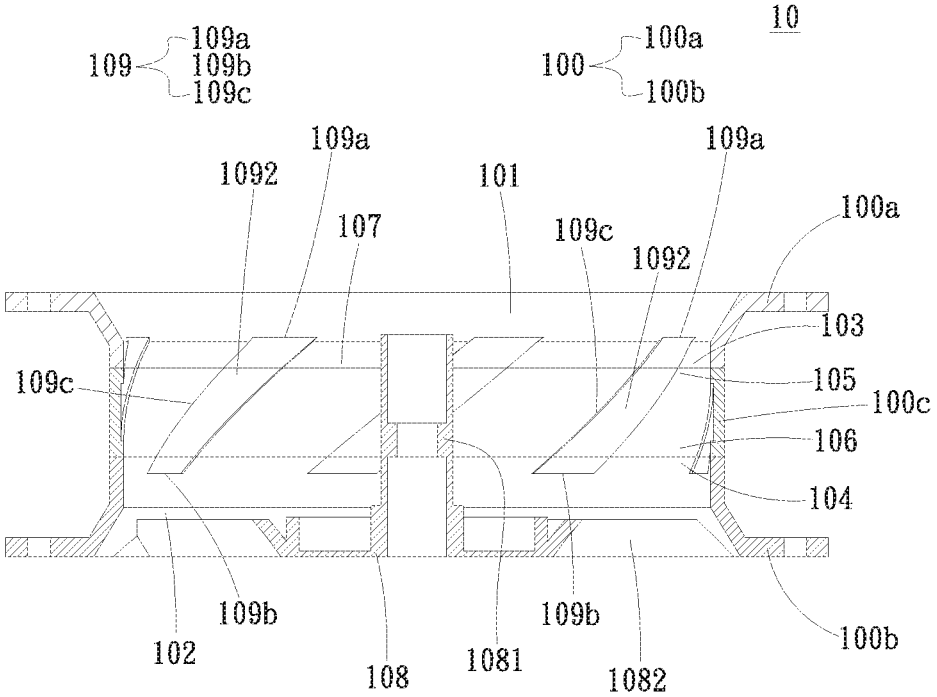
FIG. 5 is a sectional view of a third embodiment of the fan frame body with damping structure of the present invention, taken along line A-A of FIG. 1.
Figure 5:
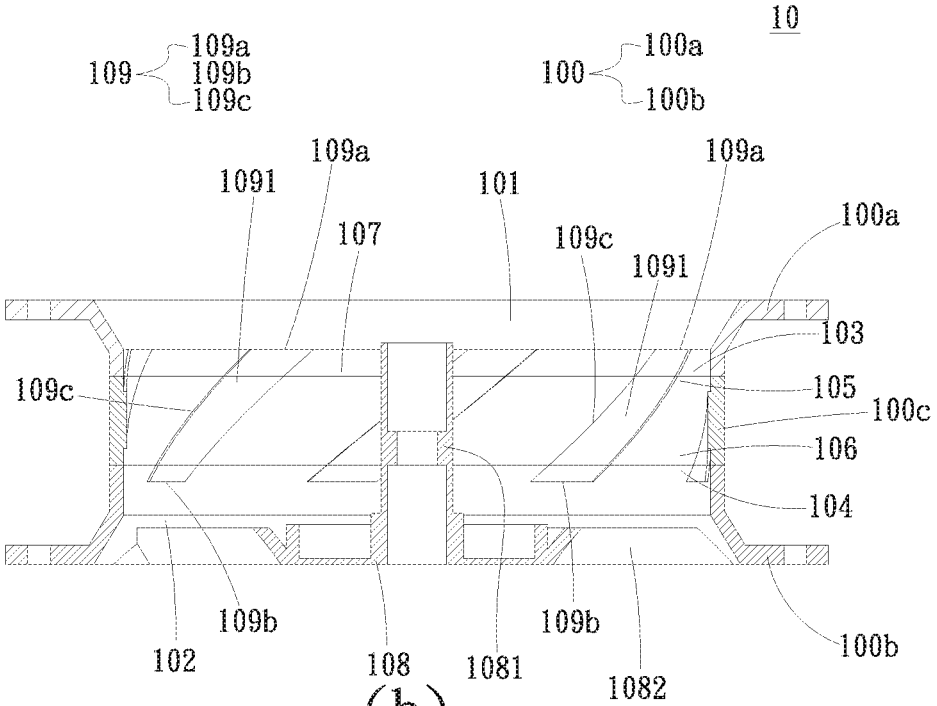

Please now refer to FIG. 5 and supplementally to FIG. 4. FIG. 5 is a sectional view of a third embodiment of the fan frame body with damping structure of the present invention, taken along line A-A of FIG. 1. The third embodiment is partially identical to the second embodiment in structure and function and thus will not be redundantly described hereinafter. The third embodiment is different from the second embodiment in that the fan frame main body 100 further has a third support frame 100*c*. A fifth opening 105 is formed on an upper side of the third support frame 100*c*. A sixth opening 106 is formed on a lower side of the third support frame 100*c*. The first, second and third support frames 100*a*, 100*b*, 100*c* are made of different materials.

The damping structure 109 further has a third part 109*c*. The third part 109*c* is formed on the third support frame 100*c*. An upper section of the third part 109*c* corresponds to the first part 109*a*. A lower section of the third part 109*c* corresponds to the second part 109*b*. The first, second and third support frames 100*a*, 100*b*, 100*c* are axially overlapped to form the fan frame main body 100. The third opening 103 corresponds to the fifth opening 105. The fourth opening 104 corresponds to the sixth opening 106. The first, second and third parts 109*a*, 109*b*, 109*c* correspondingly form the damping structure 109. The materials of the first support frame 100*a*, the second support frame 100*b* and the third support frame 100*c* are different from each other. For example, the first support frame 100*a* is made of PBT material, the second support frame 100*b* is made of PA66 material, while the third support frame 100*c* is made of PPE material. The vibration frequencies of the different materials are different from each other so that the co-vibration of the first, second and third support frames 100*a*, 100*b*, 100*c* can be further reduced to lower the noise.

Figure 6:
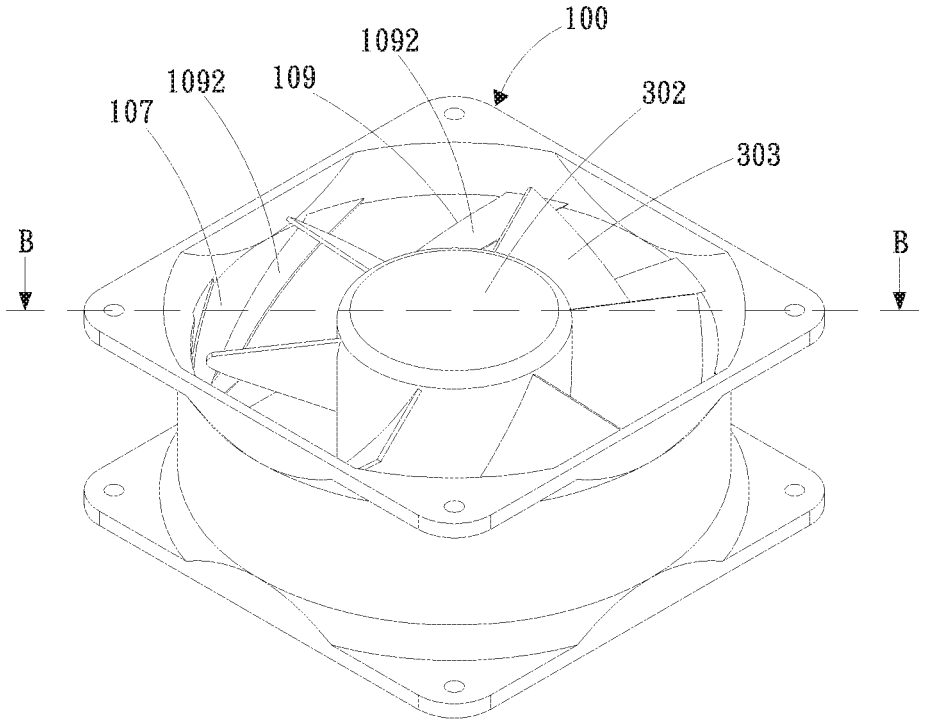
FIG. 6 is a perspective assembled view of a first embodiment of the fan of the frame body with damping structure of the present invention.
Figure 6:
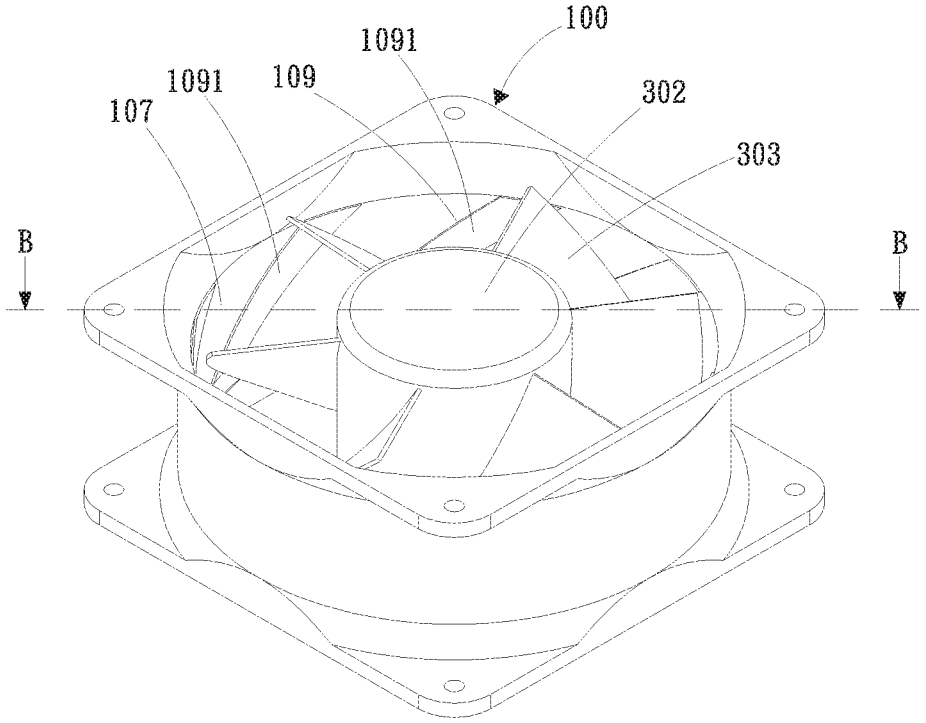
Figure 7:
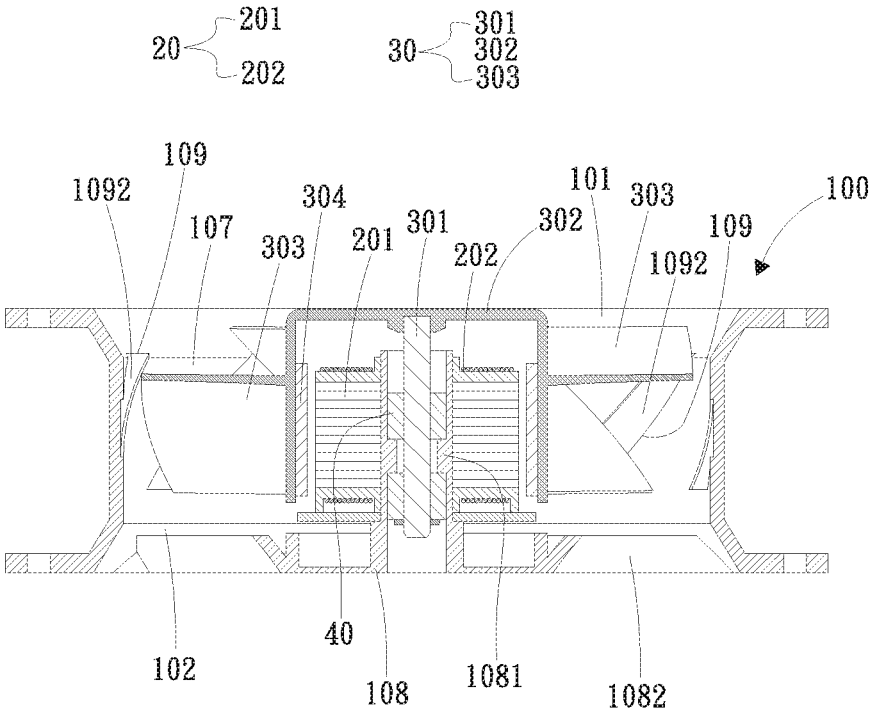
FIG. 7 is a sectional view of the first embodiment of the fan of the frame body with damping structure of the present invention, taken along line B-B of FIG. 6.
Figure 7:
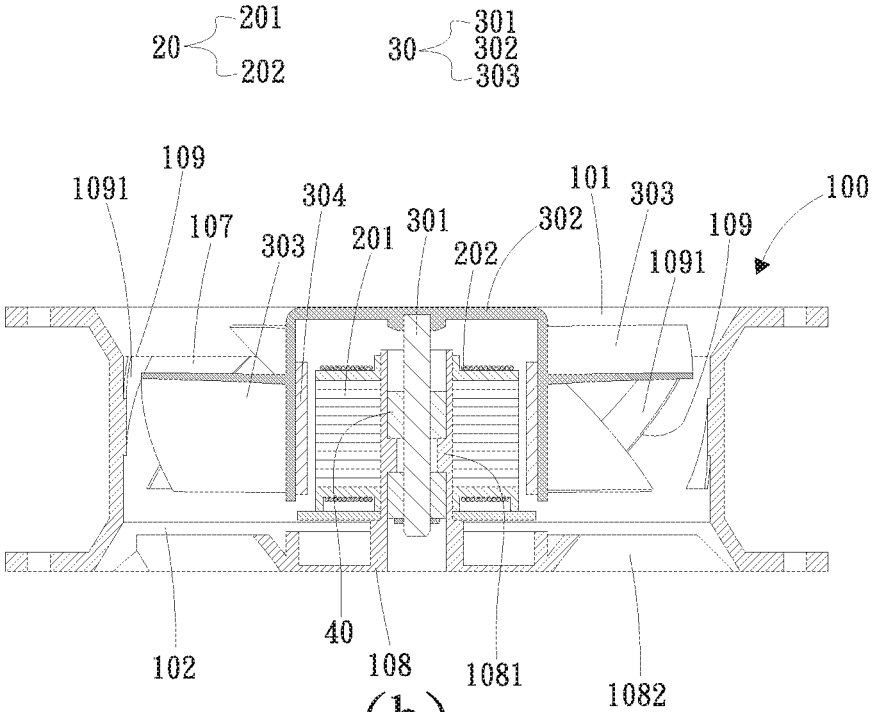

Please now refer to FIGS. 6 and 7 and supplementally to FIGS. 1 to 5. FIG. 6 is a perspective assembled view of a first embodiment of the fan of the frame body with damping structure of the present invention. FIG. 7 is a sectional view of the first embodiment of the fan of the frame body with damping structure of the present invention, taken along line B-B of FIG. 6. The fan can be applied to any of the first, second and third embodiments of the frame body with damping structure of the present invention. The frame body with damping structure of the present invention will not be redundantly described hereinafter. The fan includes a stator assembly 20, a rotor assembly 30 and a bearing 40.

The stator assembly 20 has multiple silicon steel sheets 201 and multiple windings 202 wound around the silicon steel sheets 201. The stator assembly 20 is fitted around the bearing cup 1081. The rotor assembly 30 has a central shaft 301, a hub 302 and a permanent magnet 304. The central shaft 301 is perpendicularly assembled with the hub 302. Multiple fan blades 303 are annularly disposed on outer circumference of the hub 302. The bearing 40 is disposed in the bearing cup 1081. The central shaft 301 is rotatably disposed in the bearing 40. The permanent magnet 304 is correspondingly spaced from outer surfaces of the silicon steel sheets 201.

Figure 8:
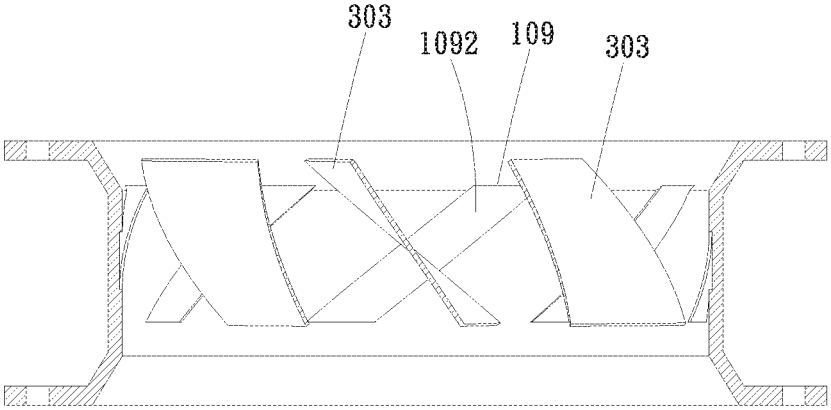
FIG. 8 is a sectional view of the first embodiment of the fan of the frame body with damping structure of the present invention, showing that the fan blade extends in a direction reverse to the direction of the damping structure.
Figure 8:
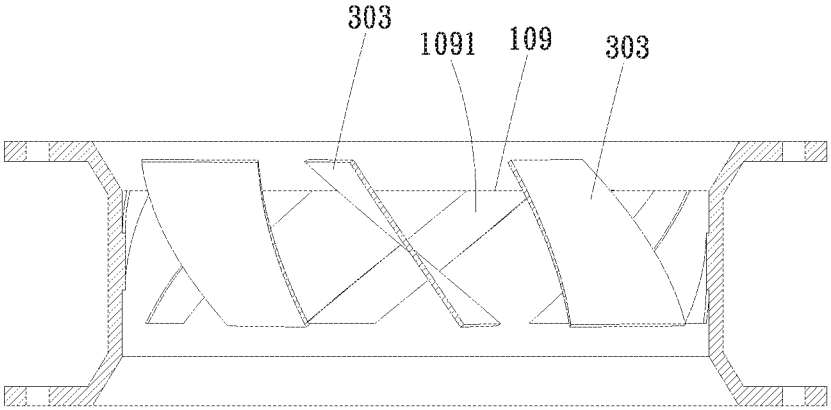

Please now refer to FIG. 8, which is a sectional view of the first embodiment of the fan of the frame body with damping structure of the present invention, showing that the fan blade extends in a direction reverse to the direction of the damping structure. The vane-shaped fan blades 303 axially extend in a direction reverse to the axial extending direction of the damping structures 109. The damping structures 109 serve to reinforce the structure of the fan frame main body 100 to lower 30~50% of the vibration amplitude of the fundamental frequency vibration created when the rotor is rotated. In this case, the equipment employing the fan, (such as a server or a computer or the like information technology equipment or a communication equipment, a domestic and audio/video equipment or an industrial equipment) can have better hard disk reading efficiency or lower the vibration of the equipment to enhance the stability. In addition, the damping structures 109 change the interaction between the free ends of the fan blades 303 and the fan frame main body 100 so as to further lower the fundamental frequency vibration and the noise.

The present invention has been described with the above embodiments thereof and it is understood that many changes and modifications in such as the form or layout pattern or practicing step of the above embodiments can be carried out without departing from the scope and the spirit of the invention that is intended to be limited only by the appended claims.

What is claimed is:

1. A fan frame body comprising:

a fan frame main body defining a cylinder axis Y and having a first opening, a second opening, a flow way, and a base section, the first and second openings being respectively positioned at upper and lower ends of the fan frame main body, the flow way being disposed between the first and second openings in fluid communication with the first and second openings, and the base section being disposed at the second opening, a bearing cup and multiple static blades perpendicularly disposed on the base section, two ends of the static blades being respectively connected with the base section and the fan frame main body, and multiple recessed and elongate damping structures annularly disposed on a cylindrical inner wall of the fan frame main body, each damping structure inclined at an angle $\alpha$ from the axis Y and having a first, open end adjacent the first opening, a second, opposite, closed end adjacent the second opening, and a bottom surface that is a constant distance from the cylindrical inner wall of the fan frame main body, such that the damping structures reinforce the fan frame main body so as to lower by 30 to 50% a vibration amplitude of a fundamental frequency vibration of the fan frame body.

2. The fan frame body as claimed in claim 1, wherein the fan frame main body has multiple support frames, the support frames being axially overlapped to form the fan frame main body and the damping structures.

3. The fan frame body as claimed in claim 2, wherein the support frames include a first support frame and a second support frame, the first opening being formed on an upper side of the first support frame, a third opening being formed on a lower side of the first support frame, the second opening being formed on a lower side of the second support frame, a fourth opening being formed on an upper side of the second support frame, the first and second support frames being made of different materials having different vibration frequencies.

4. The fan frame body as claimed in claim 3, wherein the damping structure has a first part and a second part, the first part being formed on the first support frame, the second part being formed on the second support frame corresponding to the first part, the first and second support frames being axially overlapped to form the fan frame main body, the third opening corresponding to the fourth opening, the first and second parts correspondingly forming the damping structure.

5. A fan having the fan frame body of claim 4, the fan comprising:

a stator assembly having multiple silicon steel sheets and multiple windings wound around the silicon steel sheets, the stator assembly being fitted around the bearing cup;

a rotor assembly having a central shaft, a hub and a permanent magnet, the central shaft being perpendicularly assembled with the hub, multiple fan blades being annularly disposed on an outer circumference of the hub, the permanent magnet being disposed on an inner circumference of the hub; and a bearing disposed in the bearing cup, the central shaft being rotatably disposed in the bearing.

6. The fan frame body as claimed in claim 3, wherein the support frames further include a third support frame, a fifth opening being formed on an upper side of the third support frame, a sixth opening being formed on a lower side of the third support frame, the first, second and third support frames being made of different materials having different vibration frequencies.

7. The fan frame body as claimed in claim 6, wherein the damping structure has a first part, a second part and a third part, the first part being formed on the first support frame, the second part being formed on the second support frame, the third part being formed on the third support frame, an upper section of the third part corresponding to the first part, a lower section of the third part corresponding to the second part, the first, second and third support frames being axially overlapped to form the fan frame main body, the third opening corresponding to the fifth opening, the fourth opening corresponding to the sixth opening, the first, second and third parts correspondingly forming the damping structure.

8. A fan having the fan frame body of claim 7, the fan comprising:

a stator assembly having multiple silicon steel sheets and multiple windings wound around the silicon steel sheets, the stator assembly being fitted around the bearing cup;

a rotor assembly having a central shaft, a hub and a permanent magnet, the central shaft being perpendicularly assembled with the hub, multiple fan blades being annularly disposed on an outer circumference of the hub, the permanent magnet being disposed on an inner circumference of the hub; and a bearing disposed in the bearing cup, the central shaft being rotatably disposed in the bearing.

9. A fan having the fan frame body of claim 6, the fan comprising:

a stator assembly having multiple silicon steel sheets and multiple windings wound around the silicon steel sheets, the stator assembly being fitted around the bearing cup;

a rotor assembly having a central shaft, a hub and a permanent magnet, the central shaft being perpendicularly assembled with the hub, multiple fan blades being annularly disposed on an outer circumference of the hub, the permanent magnet being disposed on an inner circumference of the hub; and a bearing disposed in the bearing cup, the central shaft being rotatably disposed in the bearing.

10. A fan having the fan frame body of claim 3, the fan comprising:

a stator assembly having multiple silicon steel sheets and multiple windings wound around the silicon steel sheets, the stator assembly being fitted around the bearing cup;

a rotor assembly having a central shaft, a hub and a permanent magnet, the central shaft being perpendicularly assembled with the hub, multiple fan blades being annularly disposed on an outer circumference of the hub, the permanent magnet being disposed on an inner circumference of the hub; and a bearing disposed in the bearing cup, the central shaft being rotatably disposed in the bearing.

11. A fan having the fan frame body of claim 2, the fan comprising:

a stator assembly having multiple silicon steel sheets and multiple windings wound around the silicon steel sheets, the stator assembly being fitted around the bearing cup;

a rotor assembly having a central shaft, a hub and a permanent magnet, the central shaft being perpendicularly assembled with the hub, multiple fan blades being annularly disposed on an outer circumference of the hub, the permanent magnet being disposed on an inner circumference of the hub; and a bearing disposed in the bearing cup, the central shaft being rotatably disposed in the bearing.

12. The fan frame body as claimed in claim 1, wherein the damping structures each have a geometrical form and respectively define a damping structure virtual axis, the damping structure virtual axes of every damping structure being parallel to each other.

13. A fan having the fan frame body of claim 12, the fan comprising:

a stator assembly having multiple silicon steel sheets and multiple windings wound around the silicon steel sheets, the stator assembly being fitted around the bearing cup;

a rotor assembly having a central shaft, a hub and a permanent magnet, the central shaft being perpendicularly assembled with the hub, multiple fan blades being annularly disposed on an outer circumference of the hub, the permanent magnet being disposed on an inner circumference of the hub; and a bearing disposed in the bearing cup, the central shaft being rotatably disposed in the bearing.

14. The fan frame body as claimed in claim 1, wherein the damping structures are uniformly annularly arranged or non-uniformly annularly arranged.

15. A fan having the fan frame body of claim 14, the fan comprising:

a stator assembly having multiple silicon steel sheets and multiple windings wound around the silicon steel sheets, the stator assembly being fitted around the bearing cup;

a rotor assembly having a central shaft, a hub and a permanent magnet, the central shaft being perpendicularly assembled with the hub, multiple fan blades being annularly disposed on an outer circumference of the hub, the permanent magnet being disposed on an inner circumference of the hub; and a bearing disposed in the bearing cup, the central shaft being rotatably disposed in the bearing.

16. A fan having the fan frame body of claim 1, the fan comprising:

a stator assembly having multiple silicon steel sheets and multiple windings wound around the silicon steel sheets, the stator assembly being fitted around the bearing cup;

a rotor assembly having a central shaft, a hub and a permanent magnet, the central shaft being perpendicularly assembled with the hub, multiple fan blades being annularly disposed on an outer circumference of the hub, the permanent magnet being disposed on an inner circumference of the hub; and a bearing disposed in the bearing cup, the central shaft being rotatably disposed in the bearing.

17. The fan frame body as claimed in claim 16, wherein the fan blades are vane-shaped and axially extend in a direction transverse to an axial extending direction of the damping structures.

18. The fan frame body of claim 1, wherein the angle $\alpha$ ranges from one degree to 179 degrees.

* * * * *